US005929384A

United States Patent [19]

Ide et al.

[11] Patent Number: 5,929,384

[45] Date of Patent: Jul. 27, 1999

[54] COVERED WIRE CONNECTION STRUCTURE

[75] Inventors: Tetsuro Ide; Nobuyuki Asakura, both of Shizuoka-ken, Japan

[73] Assignee: Yazaki Corporation, Tokyo, Japan

[21] Appl. No.: 08/856,590

[22] Filed: May 15, 1997

[30] Foreign Application Priority Data

May 23, 1996 [JP] Japan ..... 8-128688

[51] Int. Cl.[6] ..... H01R 4/00

[52] U.S. Cl. ..... 174/84 R; 174/94 R

[58] Field of Search ..... 174/72 C, 84 C, 174/94 R

[56] References Cited

U.S. PATENT DOCUMENTS

| | | | |
|---|---|---|---|
| 2,250,156 | 7/1941 | Furguson | 174/84 R X |
| 5,455,741 | 10/1995 | Wai et al. | 361/761 |
| 5,584,122 | 12/1996 | Kato et al. | 174/84 R X |

FOREIGN PATENT DOCUMENTS 7-320842 12/1995 Japan .

*Primary Examiner*—Kristine Kincaid
*Assistant Examiner*—Chau N. Nguyen
*Attorney, Agent, or Firm*—Finnegan, Henderson, Farabow, Garrett & Dunner, L.L.P.

[57] ABSTRACT

Two covered wires to be conductively connected with each other are overlapped with each other at connection portions. The overlapped connection portions are pinched by a pair of resin chips and then cover portions are melted and conductive wire portions of the covered wires are conductively contacted with each other by pressing from the outside of the resin chips at the connection portions. The pair of the resin chips are melted together to seal the connection portions. The pair of the resin chips are provided with wire introducing hole portions formed in a shape of non-through hole gradually narrowing from the introducing end toward the connection portion when the resin chips are fit together. With the cover portions at least at the introducing ends of the covered wires in the wire introducing hole portions left, the resin chips are melted together. Thus, it is possible to ensure an excellent melting operation efficiency and improve the mechanical strength of the entire connection portions.

8 Claims, 4 Drawing Sheets

COVERED WIRE CONNECTION STRUCTURE

BACKGROUND OF THE INVENTION

This invention relates to a connection method and structure for connecting covered wires with each other or connecting a covered wire to another member.

As a conventional connection structure for this kind of covered wires, an art proposed by this inventor (see Japanese Laid-Open Patent Application No. 7-320842) will be described.

For connecting two covered wires the outer periphery of which is coated with a cover portion made of resin, at their intermediate connection portions, a pair of resin chips which are of resin material, a horn for producing ultrasonic vibration, and an anvil for supporting the covered wires and resin chips at the time of connection are utilized. The anvil includes a base stand and a support portion projecting from the base stand. The support portion is designed in a substantially cylindrical shape. The support portion has a bore portion which is opened at the opposite side to the base stand side. Two pairs of grooves are formed on the peripheral wall of the support portion so as to cross with each other substantially at the center of the bore portion. The four grooves are formed so as to open on the same side as the bore portion, extending along the projection direction of the support portion and intercommunicate with one another through the bore portion.

The pair of resin chips are designed in a disc shape having a slightly smaller outer diameter than the diameter of the bore portion of the anvil. Furthermore, an end face of a head portion of the horn is designed in a disc shape having an outer diameter which is substantially equal to or slightly smaller than that of the resin chips.

In order to connect the two covered wires to each other, both of the covered wires are overlapped with each other at the connection portion thereof and the overlapped connection portions are pinched by the pair of resin chips from the upper and lower sides of the connection portions. Specifically, one of the resin chips (the resin chip at the lower side) is inserted into the bore portion of the anvil such that the melting surface thereof is directed upward. Then, one covered wire is inserted into the pair of confronting grooves from the upper side of the inserted resin chip. Then, the other covered wire is inserted into the other pair of the confronting grooves. Finally, the other (upper side) resin chip is inserted such that the melting surface is directed downward. The covered wires are arranged in the bore portion so that the respective connection portions thereof cross each other at the center of the bore portion. Through this arrangement, the connection portions of the covered wires are pinched substantially at the center of the melting surfaces of the upper and lower resin chips respectively in the overlapping direction.

Subsequently, the cover portions at the connection portions of the covered wires are melted so as to be dispersed by ultrasonic vibration. Furthermore, the conductive wire portions (core) of the covered wires are conductively contacted with each other at the connection portion by pressing the covered wires from the outside of the resin chips. Thereafter, the pair of the resin chips are mutually melt-fixed at the melting surfaces to seal the connection portion.

Specifically, the head portion of the horn is inserted into the bore portion from the upper side of the finally-inserted upper (other) resin chip and placed on the upper resin chip to excite and press the connection portions of the covered wires from the outside of the upper and lower resin chips between the horn and the anvil. The cover portions are first melted and the conductive wire portions of the covered wires are exposed at the connection portion between the resin chips. At this time, the melted cover portions are extruded from the center side of the resin chips toward the outside thereof because the connection portions are pressed from the upper and lower sides, so that the conductive wire portions are more excellently exposed and surely conductively contacted with each other. Like the press direction, the direction of the excitation of the connection portions is set to be coincident with the overlapping direction of the covered wires, so that the action of extruding the melted cover portions from the center side of the resin chips to the outside thereof is promoted.

When the pressing and exciting operation on the connection portions is further continued after the melting of the cover portions, the resin chips are melted and the confronting melting surfaces of the resin chips are melt-fixed to each other. In addition, the outer peripheral surface portions of the cover portions which are adjacent to the conductively contacted conductive wire portions and the resin chips are melt-fixed. With this operation, the outer peripheral portions of the conductively-contacted conductive wire portions are kept to be coated with the resin chips.

However, in the above described structure, a soft conductive wire portion exposed by dispersing the cover portion is contacted with corners of the resin chips at introducing ends of the covered wire, such that melted resin covers and seals a portion between the corners of the resin chips and the cover portion. Thus, if pressing and excitation of the horn are increased too much to secure a sufficient melting force, the corners of the aforementioned introducing ends are strongly pressed by the conductive wire portion when the upper and lower resin chips are melted together, so that the conductive wire portion may be damaged. Thus, to secure sealing condition of the resin chips and prevent the conductive wire portion from being damaged, it is necessary to set a melting condition (e.g., ultrasonic energy, pressure, pressing and excitation time, etc.) by pressing and excitation in details and manage it. Thus, the melting work is very complicated.

Further, if the covered wires are bent in a desired shape after the melting, an applied external force may be concentrated on a portion at the aforementioned introducing end in which the corner of the resin chip is contacted with the conductive wire portion, thereby possibly inducing a damage in the conductive wire portion. Thus, durability of the conductive wire portion at the introducing ends may determine the mechanical strength of the entire connection portion, so that it may be impossible to obtain a desired mechanical strength in the entire connection portion.

SUMMARY OF THE INVENTION

It is therefore an object of the present invention to provide a covered wire connection structure ensuring an excellent melting performance and capable of improving mechanical strength of entire connection portions including introducing ends of covered wires against resin chips.

In order to achieve the above object, according to the present invention, there is provided a covered wire connection structure of conductively connecting members at least one of which is a covered wire having a conductive wire portion and a cover portion formed by coating resin around an outer periphery of the conductive wire portion, the structure being formed by overlapping the members with each other and pinching an overlapping portion of the members between a pair of resin chips, pressurizing and exciting the overlapping portion pinched by the resin chips using an ultrasonic vibration welding apparatus so as to melt and disperse the cover portion, thereby to expose the conductive wire portion and electrically conductively connect the conductively wire portions of the members at the overlapping portion and so as to melt-fix the pair of resin chips to seal the connected overlapping portion of the members with the melted resin chips, characterized in that wire introducing hole portions are formed in the pair of the resin chips in a shape of non-through hole gradually narrowing from introducing ends toward the connection portions of the covered wires when the resin chips are overlapped with each other, the wire introducing hole portions make at least cover portions at the introducing ends of the covered wires left in a state in which the resin chips are melted together.

The wire introducing hole portions can be formed in a substantially conical shape corresponding to an outer peripheral shape of the covered wire.

According to the construction described above, during or after the melting of the resin chips, the cover portion at least at the introducing ends in the wire introducing hole portion is left and the left cover portion gradually becomes thinner so as to contact an internal surface of the wire introducing hole portion. Thus, at the introducing ends, the hard resin chips never directly contact the conductive wire portion, thus obtaining so-called cushioning effect by the cover portion existing between the resin chip and the conductive wire portion.

Thus, shearing force applied by the upper and lower resin chips by pressing and excitation at the time of melting does not act directly on the conductive wire portion but acts thereon through the soft cover portion. Thus, the shearing force is relaxed and it is not necessary to set the melting condition by pressing and excitation in details and manage it in order to prevent the conductive wire portion from being damaged.

Further, if an external force is applied to the covered wires after the melting, the external force is dispersed in the resin chips through the cover portion at the aforementioned introducing ends, thereby preventing the conductive wire portion from being damaged due to concentration of the external force.

That is, the cover portion existing at least at the introducing ends in the wire introducing hole portion provides a cushioning effect. As a result, a shearing force to be applied to the conductive wire portion at the time of melting is relaxed. Further, because the external force is dispersed after the melting, it is possible to improve the mechanical strength of the entire connection portion including the introducing ends of the covered wires against the resin chips, without reducing the melting operation efficiency.

DESCRIPTION OF THE PREFERRED EMBODIMENTS

Hereinafter, an embodiment of the present invention will be described with reference to the accompanying drawings.

Figure 1:
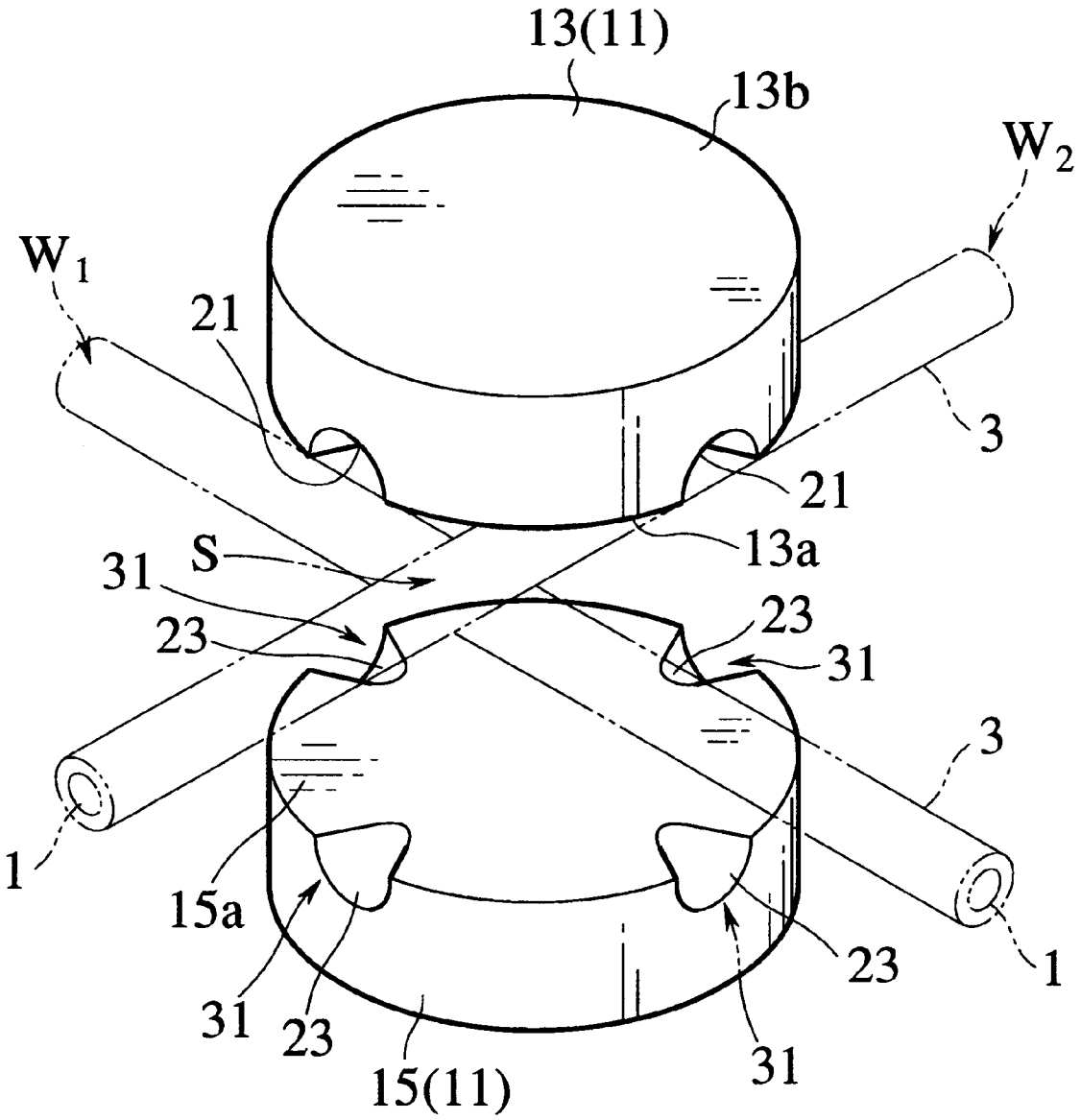
FIG. 1 is a perspective view showing a connection structure for covered wires according to an embodiment of the present invention, indicating a state in which upper and lower resin chips are separated.
Figure 2:
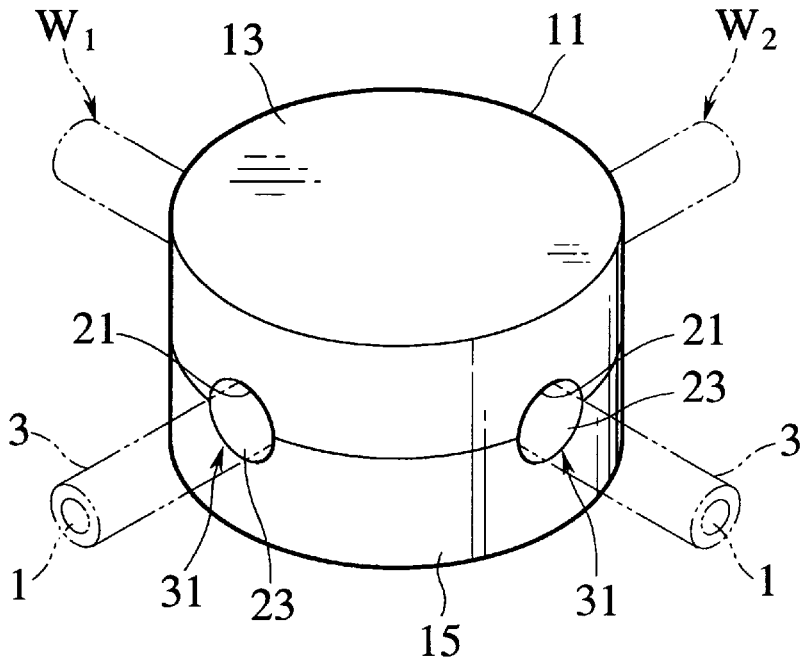
FIG. 2 is a perspective view showing a connection structure for covered wires according to an embodiment of the present invention, indicating a state in which the upper and lower resin chips are fit together at contacting surfaces.
Figure 3:
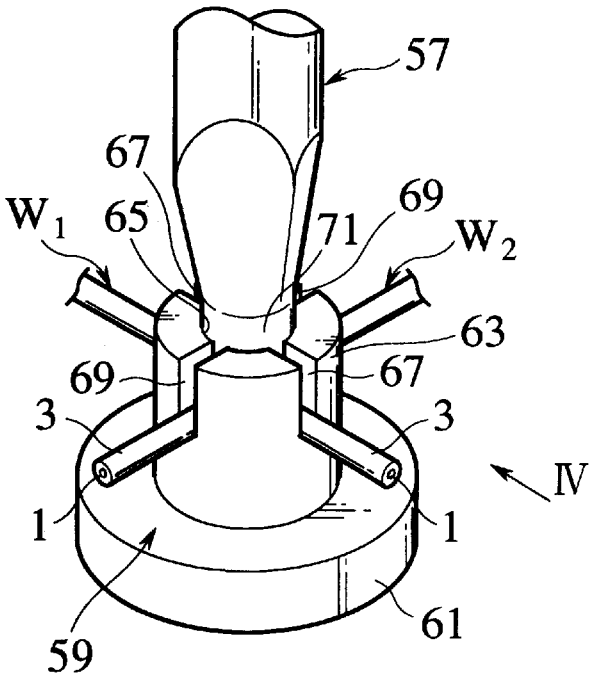
FIG. 3 is a perspective view of a state just after melting operation is started, indicating a means for obtaining a melting structure of covered wires according to an embodiment of the present invention.
Figure 4:
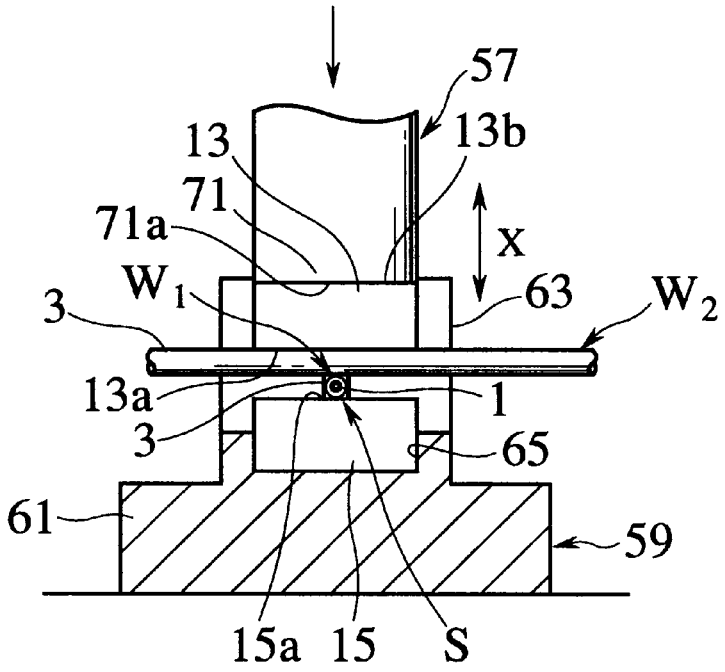
FIG. 4 is a schematic view showing a cross section of major portion taken from the direction of IV in FIG. 3.
Figure 5:
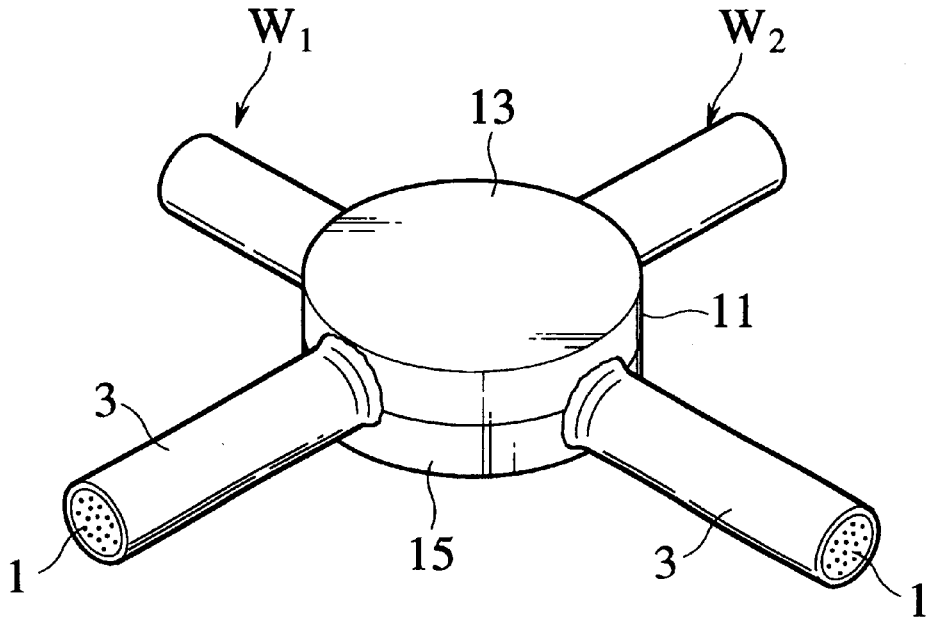
FIG. 5 is a perspective view showing a state after the resin chips are melted.
Figure 6:
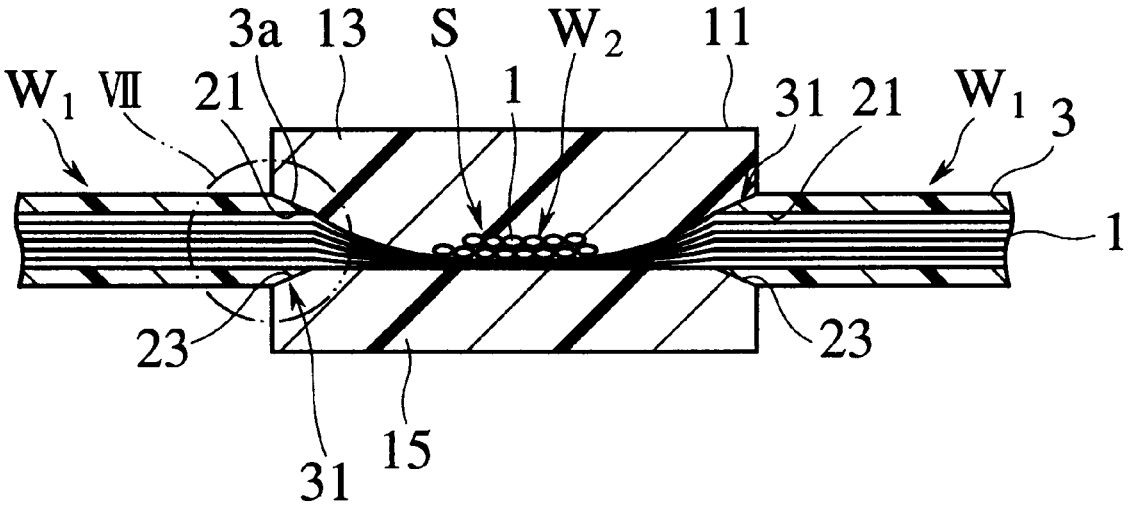
FIG. 6 is a side sectional view of FIG. 5.
Figure 7:
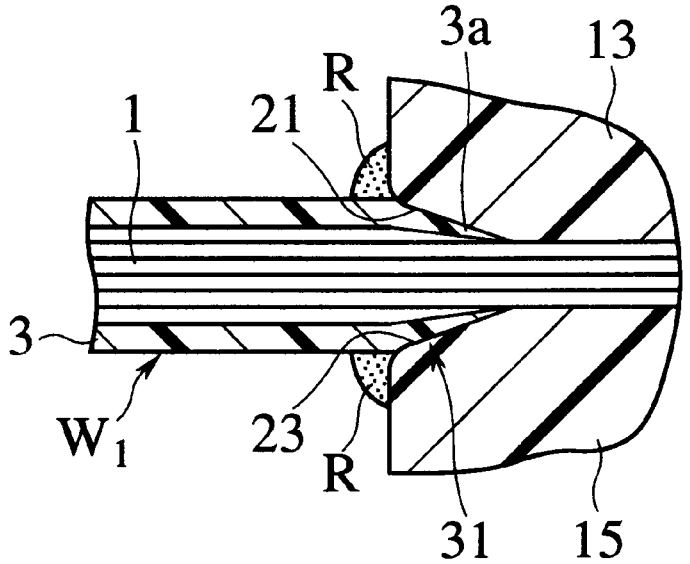
FIG. 7 is an enlarged view of the portion VII of FIG. 6.

FIGS. 1, 2 are perspective views showing a connection structure of a covered wire according to this embodiment. FIG. 1 shows a state in which upper and lower chips are separated from each other and FIG. 2 shows a state in which the upper and lower chips are contacted with each other. FIG. 3 is a perspective view of a state just after connection is started, showing a means for obtaining a connection structure for the covered wires according to the instant embodiment. FIG. 4 is a schematic view showing a cross section taken along the line indicated by the arrow IV in FIG. 3. FIG. 5 is a perspective view showing a state after resin chips are melted together. FIG. 6 is a side sectional view of FIG. 5 and FIG. 7 is an enlarged view of the portion indicated by VII of FIG. 6.

According to the instant embodiment shown in FIG. 1, two covered wires W1, W2 each of which comprises a conductive wire portion 1 and a cover portion 3 which is formed of resin and coated around the outer periphery of the conductive wire portion, are conductively connected to each other at connection portions S thereof as shown in FIG. 1.

First, a connection method for the covered wires W1, W2 according to the instant embodiment will be described. For the connection of the two covered wires W1, W2 are used a pair of resin chips 13, 15 serving as a resin material 11, a horn 57 for producing ultrasonic vibration as shown in FIG. 3 and an anvil 59 for supporting the covered wires W1, W2 and the resin chips 13, 15 when the connection between the covered wires is performed. The anvil 59 includes a base stand 61 and a support portion 63 projecting from the base stand 61. The support portion 63 is designed in a substantially cylindrical shape. The support portion 63 has a bore portion 65 which is opened at the opposite side to the base stand side (at the upper side in the same Figure) and has a rectangular cross section. Two pairs of grooves 67, 69 are formed on the peripheral wall of the support portion 63 so as to cross with each other substantially at the center of the bore portion 65. The four grooves 67, 69 are formed so as to open on the same side as the bore portion 65, extending along the projection direction of the support portion 63 and intercommunicate with one another through the bore portion 65.

The pair of resin chips 13, 15 (see FIG. 1) are designed in a disc shape having a slightly smaller outer diameter than the diameter of the bore portion 65 of the anvil 59. Furthermore, an end face of a head portion 71 of the horn 57 is designed in a disc shape having an outer diameter which is substantially equal to or slightly smaller than that of the resin chips 13, 15. As material of the resin chips 13, 15 may be used acrylic resin, ABS (acrylonitrile-butadiene-styrene copolymer) resin, PC (polycarbonate) resin, PVC (polyvinyl chloride) resin, PE (polyethylene) resin, PEI (polyetherimide), PBT (polyethylene terephtalate) or the like. Generally, harder material than vinyl chloride or the like for use in the covered portion 3 is utilized. As for adaptability of these resin material for the resin chips 13, 15, all these resin materials are recognized to be actually effective in terms of conductivity and conductive stability. If judging from appearance and insulation performance as well, particularly the PEI resin and PBT resin are the most suitable and acrylic resin and PC resin are next suitable.

As shown in FIGS. 1, 2, respective surfaces of the resin chips 13, 15 have melting surfaces 13*a*, 15*a* which are in contact with each other when the resin chips 13, 15 are overlapped with each other in the bore portion 65 of the anvil 59. The connection portion S in which the two covered wires W1, W2 cross each other is located at a central portion of the melting surfaces 13*a*, 15*a*.

The upper and lower resin chips have four hole portion forming grooves 21, 23 each. The hole portion forming grooves 21, 23 are in split circle shape which forms four wire introducing portions when the upper and lower resin chips 13, 15 are overlapped with each other. That is, the hole portion forming grooves 21 of the upper resin chip 13 form upper sections of the wire introducing hole portion 31 and the hole portion forming grooves 23 of the lower resin chip 15 form lower sections of the wire introducing hole portions 31. The wire introducing hole portions 31 are formed in a non-through hole shape which narrows toward the connection portion S (center portions of the melting surfaces 13*a*, 15*a*) from introducing ends (external peripheral surfaces of the resin chips 13, 15) of the covered wires W1, W2. The wire introducing hole portions are formed in substantially conical shape corresponding to external peripheral surface formation of the covered wires W1, W2. The maximum diameter of the wire introducing hole portion 31 at the aforementioned introducing end is substantially equal to or slightly larger than the outside diameter of the cover portion 3 of the covered wires W1, W2. Circular bottoms of the respective hole portion forming grooves 21, 23 are formed so as to gradually narrow with respect to the center portion of the melting surfaces 13*a*, 15*a*. In the center portion of the melting surfaces 13*a*, 15*a* surrounding the connection portion S, a sufficient area for covering the connection portion S is ensured.

In order to connect the two covered wires W1, W2 to each other, both of the covered wires W1, W2 are overlapped with each other at the connection portion S thereof and the overlapped connection portions S are pinched by the pair of resin chips 13, 15 from the upper and lower sides of the connection portions such that the respective covered wires W1, W2 are introduced from the wire introducing hole portions 31. Specifically, one of the resin chips 15 (the resin chip 15 at the lower side) is inserted into the bore portion 65 of the anvil 59 with each of the hole portion forming grooves 21 coinciding with each groove portions 67, 69 such that the melting surface 15*a* thereof is directed upward. Then, one covered wire W1 is inserted into the pair of confronting grooves 67 from the upper side of the inserted resin chip 15. Then, the other covered wire W2 is inserted into the other pair of the confronting grooves 69. Finally, the other (upper side) resin chip 13 is inserted with each of the hole portion forming groove 23 coinciding with each of the grooves 67, 69 such that the melting surface 13*a* is directed downward. The covered wires W1, W2 are arranged in the bore portion 65 so that the respective connection portions S thereof cross each other at the center of the bore portion 65. Through this arrangement, the connection portions S of the covered wires are pinched substantially at the center of the melting surfaces 13*a*, 15*a* of the upper and lower resin chips 13, 15 respectively in the overlapping direction.

Subsequently, the cover portions 3 at the connection portions S of the covered wires are melted so as to be dispersed by ultrasonic vibration. Furthermore, the conductive wire portions (core) of the covered wires W1, W2 are conductively contacted with each other at the connection portion S by pressing the covered wires from the outside of the resin chips 13, 15. Thereafter, the pair of the resin chips 13, 15 are mutually melted at the melting surfaces 13*a*, 15*a* to seal the connection portion S.

Specifically, as shown in FIG. 4, a head portion 71 of the horn 57 is inserted into the bore portion 65 from the upper side of the finally-inserted upper resin chip 13 and the connection portion S is excited and pressed from the outside of the upper and lower resin chips 13, 15 between the horn 57 and the anvil 59. The press of the connection portion S is performed by pressing the horn 57 toward the anvil 59, and the press direction is coincident with the overlapping direction of the covered wires.

When the resin materials 11 are melt-fixed to each other by the ultrasonic vibration, the excitation is preferably performed in a direction which substantially perpendicularly intersects to the connection surface of the resin materials 11 because it provides the most excellent melt-fixing state. Therefore, the direction of the excitation of the connection portion S is set to a direction which crosses the confronting surfaces 13*a*, 15*a* of the resin chips, that is, it is set to be coincident with the overlapping direction of the covered wires W1, W2 (as indicated by the arrow X in FIG. 4). With this arrangement, longitudinal vibration is produced from the horn 57.

When the connection portion S is pressed and excited in the above state, the cover portions 3 are first melted and the conductive wire portions 1 of the covered wires W1, W2 are exposed at the connection portion S between the resin chips 13 and 15. At this time, the melted cover portions 3 are extruded from the center side of the resin chips 13, 15 toward the outside thereof because the connection portions S are pressed from the upper and lower sides, so that the conductive wire portions 1 are more excellently exposed and surely conductively contacted with each other. Like the press direction, the direction of the excitation of the connection portions S is set to be coincident with the overlapping direction of the covered wires W1, W2, so that the action of extruding the melted cover portions 3 from the center side of the resin chips 13, 15 to the outside thereof is promoted.

When the pressing and exciting operation on the connection portions S is further continued after the melting of the cover portions 3, the resin chips 13, 15 are melted and the confronting melting surfaces 13*a*, 15*a* of the resin chips 13, 15 are melted to each other. In addition, the outer peripheral surface portions of the cover portions 3 which are adjacent to the conductively contacted conductive wire portions 1 and the resin chips 13, 15 are melt-fixed (see FIG. 5). With this operation, the outer peripheral portions of the conductively contacted conductive wire portions 1 are kept to be coated with the resin chips 13, 15.

The covered wires W1, W2 are introduced through the wire introducing hole portions 31 (hole portion forming grooves 21, 23). The wire introducing holes 31 are formed in a non-through hole shape gradually narrowing from the maximum diameter at the introducing ends which is substantially equal to or slightly larger than the external diameter of the cover portions 3 of the covered wires W1, W2 toward the connection portion S (center portion of the melting surfaces 13*a*, 15*a*). As shown in FIGS. 6, 7, the cover portion 3*a* at least at the introducing end of the covered wires W1, W2 in the wire introducing hole portion 31 remains such that it becomes gradually thinner toward the connection portion S during melting and after melting. Thus, at the introducing ends, the resin chips 13, 15 never directly contact the conductive wire portion 1. Symbol R in FIG. 7 indicates melted resin which is extruded out of the resin chips 13, 15 at the time of melting and hardened.

According to the connection method of the instant embodiment, the covered wires W1, W2 are overlapped with each other at the connection portion S and with the connection portion S being pinched by the pair of the resin chips 13, 15, the cover portion 3 is pressed from the outside of the resin chips 13, 15 so as to be dispersed and melted. Then, the covered wires W1, W2 can be conductively contacted with each other at the connection portion S. Thus, it is not necessary to remove the cover portions 3 to make the covered wires W1, W2 conductively contacted with each other, and thus it is possible to make them conductively contacted with each other by a simple operation.

Furthermore, according to the connection method and a connection structure obtained thereby, after the covered wires W1, W2 are conductively contacted with each other at the connection portion S, the upper and lower resin chips 13, 15 are melted together so as to seal the connection portion S. Thus, it is possible to obtain a high mechanical strength at the connection portion S by the melted and hardened resin chips 13, 15.

Because the resin chips 13, 15 have only to have a dimension capable of pinching the connection portion S conductively contacted from the upper and lower sides of the resin chips 13, 15, a range required for connection can be suppressed to a small range. Further, because the connection portion S is sealed by the resin chips 13, 15, it is possible to secure a sufficient insulation performance.

Thus, by a high mechanical strength and a sufficient insulation performance, it is possible to stabilize conductive characteristic between the covered wires W1 and W2 at the connection portion S.

The connection method according to the present embodiment is a relatively simple method in which the overlapped connection portions S are pinched by the resin chips 13, 15 and the connection portions S are pressed and excited between the horn 57 and the anvil 59 from the outside of the resin chips 13, 15. Further, the connection method and structure according to the instant embodiment do not restrict one covered wire W1 and the mating member to be conductively connected therewith (the other covered wire W2 in the instant embodiment) to any particular shape. Thus, this connection method and structure can be applied to various connections such as connection of the covered wires W1, W2 with terminals thus obtaining a wide availability.

Furthermore, the covered wires W1, W2 are pinched by the pair of the resin chips 13, 15 in the overlapping direction thereof and the connection portions S are pressed and excited between the horn 57 and the anvil 59 from the outside of the resin chips 13, 15 and the direction of the pressing is set to the same as the direction in which the covered wires W1, W2 are overlapped with each other. Thus, when the connection portion S is pressed, the melted cover portions 3 are extruded out from the center portion of the resin chips 13, 15 so that the conductive wire portions 1 are exposed excellently thereby obtaining a secure conductive contacting state. Further, because the direction of excitation to the connection portion S is set to the same as the direction in which the covered wires W1, W2 are overlapped with each other like the pressing direction, it is possible to obtain excellent melting condition of the resin chips 13, 15 and enhance an action of pushing out the cover portions 3.

Further, because the resin chips 13, 15 are provided with the wire introducing hole portions 31, as shown in FIGS. 6, 7, the cover portions 3*a* at least at the introducing ends in the wire introducing hole portions 31 are left at the time and after the melting of the resin chips 13, 15 and this left cover portions 3*a* become gradually thinner so as to contact an internal surface of the wire introducing hole portions 31. Thus, the hard resin chips 13, 15 are never directly in contact with the conductive wire portions 1 at the introducing ends and the cover portions 3*a* existing between the resin chips 13 and 15 elastically supports the conductive wire portions 1 thereby obtaining a cushioning effect by the cover portions 3*a*.

Thus, shearing force applied from the upper and lower resin chips 13, 15 by pressing and excitation at the time of melting does not act directly on the conductive wire portions 1, but acts through the mild cover portions 3*a*. Thus, the shearing force is relaxed and even if detailed melting condition is not set and controlled, there is no possibility that the conductive wire portion 1 may be damaged.

If an external force is applied to the covered wires W1, W2 after melting, it is dispersed to the resin chips 13, 15 through the cover portions 3*a* at the aforementioned introducing ends. Thus, it is possible to suppress a damage of the conductive wire portion 1 due to concentration of external force.

As a result, it is possible to enhance mechanical strength of the entire connection portions S including the introducing ends of the covered wires W1, W2 against the resin chips 13, 15 without reducing melting operation efficiency.

It is permissible to use the resin chips 13, 15 having a relatively low viscosity at the time of melting. Then, when melting the resin chips 13, 15 so as to surround the connection portion S, the melted resin chips 13, 15 may be filled in gaps between plural core wires composing the conductive wire portion 1 in the neighboring conductive wire portions 1 excluding the connection portion S to fill gaps formed between the cover portions of the covered wires W1, W2 and the core wires or gaps formed between the core wires with resin material 11 thereby obtaining an effect of sealing against water inside of the covered wires W1, W2. Thus, for example, in a case in which one end of the covered wires W1, W2 is connected to a portion requiring waterproof (waterproofed portion) and the other end thereof is connected to a portion not requiring water proof (non-waterproofed portion), water or the like enters inside of the covered wires W1, W2 from the other end due to capillary phenomenon and flows inside of the covered wires W1, W2. However, water is prevented from entering to the one end by the aforementioned effect of sealing against water. Thus, it is possible to secure water proof performance at the one end without providing the other end with water proof structure. That is, if both ends of the covered wires W1, W2 are connected to the water proofed portion and the non-waterproofed portion, it is possible to secure waterproof performance in the waterproofed portion without providing the non-waterproofed portion with a waterproofing structure, by a simple and cheap method and structure.

What is claimed is:

1. A covered wire connection structure for conductively connecting members, at least one of the members including a covered wire having a conductive wire portion and a cover portion formed by coating resin around an outer periphery of the conductive wire portion, said structure being formed by overlapping said members with each other and pinching an overlapping portion of said members between a pair of resin chips, pressurizing and exciting said overlapping portion pinched by said resin chips using an ultrasonic vibration welding apparatus so as to melt and disperse said cover portion, thereby to expose the conductive wire portion and electrically conductively connect the conductive wire portion of said one member with the other member at said overlapping portion and so as to melt-fix said pair of resin chips to seal the overlapping portion with said resin chips, characterized in that:

a wire introducing hole portion is formed in said pair of resin chips overlapped with each other in a shape of non-through hole gradually narrowing from an introducing end of said covered wire toward said overlapping portion, and wherein the cover portion on the conductive wire portion at the introducing end of said wire introducing hole portion remains when said resin chips are melted together.

2. A covered wire connection structure according to claim 1 wherein said wire introducing hole portion is formed in a substantially conical shape corresponding to an outer peripheral shape of the covered wire.

3. A covered wire connection structure according to claim 1, wherein the cover portion on the conductive wire portion at the introducing end of said wire introducing hole portion remains in an unmelted state when said resin chips are melted together.

4. A covered wire connection structure according to claim 3, wherein said wire introducing hole portion is formed in a substantially conical shape corresponding to an outer peripheral shape of the covered wire.

5. A covered wire connection structure for conductively connecting first and second covered wires, each of the covered wires having a conductive wire portion and a cover portion formed by coating resin around an outer periphery of the conductive wire portion, said structure being formed by overlapping said covered wires with each other and pinching an overlapping portion of said covered wires between a pair of resin chips, pressurizing and exciting said overlapping portion pinched by said resin chips using an ultrasonic vibration welding apparatus so as to melt and disperse the cover portions of the covered wires, thereby to expose the conductive wire portions of the covered wires and to seal electrically and conductively the overlapping portion with said resin chips, characterized in that:

wire introducing hole portions are formed in said pair of resin chips overlapped with each other, each of the wire introducing hole portions is formed in a shape of non-through hole gradually narrowing from an introducing end of each of the covered wires toward said overlapping portion, and wherein the cover portion on each conductive wire at the introducing end of each of the wire introducing hole portions remains when said resin chips are melted together.

6. A covered wire connection structure according to claim 5 wherein each of the wire introducing hole portions is formed in a substantially conical shape corresponding to an outer peripheral shape of each of the covered wires.

7. A covered wire connection structure according to claim 5, wherein the cover portion on each conductive wire portion at the introducing end of each of the wire introducing hole portions remains in an unmelted state when said resin chips are melted together.

8. A covered wire connection structure according to claim 7, wherein each of the wire introducing hole portions is formed in a substantially conical shape corresponding to an outer peripheral shape of each of the covered wires.

* * * * *